United States Patent [19]

Uhlig

[11] 4,177,527

[45] Dec. 11, 1979

[54] LATCH ON MASQUERADER UNIT

[75] Inventor: Richard E. Uhlig, Burlingame, Calif.

[73] Assignee: Aluminum Plumbing Fixture Corp., South San Francisco, Calif.

[21] Appl. No.: 960,968

[22] Filed: Nov. 15, 1978

[51] Int. Cl.[2] ..... A47K 4/00

[52] U.S. Cl. ..... 4/3; 4/DIG. 2; 292/123

[58] Field of Search ..... 4/3, DIG. 2, 312; 292/DIG. 49, 223, 123; 312/314, 317

[56] References Cited

U.S. PATENT DOCUMENTS

| | | | |
|---|---|---|---|
| 2,016,519 | 10/1935 | Schmidt | 292/123 |
| 2,195,542 | 4/1940 | Shaffer et al. | 292/DIG. 49 |
| 2,893,773 | 7/1959 | Clifton | 292/223 |
| 4,089,073 | 5/1978 | Campbell | 4/3 |
| 4,142,256 | 3/1979 | Campbell | 4/DIG. 2 |

*Primary Examiner*—Lenard A. Footland
*Attorney, Agent, or Firm*—Robert G. Slick

[57] ABSTRACT

A stabilizing latch is provided for a combination unit having a fixed toilet bowl and a wash basin which is hingedly mounted on the unit and adapted to swing over the toilet bowl when the toilet bowl is not in use and to swing outwardly to permit use of the toilet bowl. The stabilizing latch automatically clamps the swinging wash basin to the floor when the latch is released. This feature is particularly valuable for aged or infirm people who may wish to use the wash basin for support while utilizing the toilet.

2 Claims, 4 Drawing Figures

LATCH ON MASQUERADER UNIT

SUMMARY OF THE INVENTION

The present invention relates to a combination fixture which is particularly adapted for use in hospital rooms and rest homes wherein a wash basin and a toilet are combined. Such fixtures are popular since they do not require a separate enclosure so that each room can be easily equipped with its own toilet and wash bowl.

The present invention is particularly applicable to such a unit wherein the toilet bowl has a fixed mounting and wherein the wash basin is mounted on hinges so that it can swing outwardly from a wall to permit the use of the toilet or can be swung back against the wall to conceal the toilet and make the wash basin available for use.

Since such fixtures are frequently used by the elderly and infirm, it is particularly important that the fixtures be stable since patients will frequently use the wash basin structure for support in getting on and off the toilet.

Accordingly, it is the primary object of the present invention to provide a stabilizing structure so that the wash basin of a combination unit will be clamped to the floor so that it will provide firm support for a user when the wash basin is swung to the outer or inoperative position.

A secondary feature of the present invention is that it is entirely automatic in operation. The stabilizing latch is provided with a spring so that the lever arm must be manually raised to allow the swinging movement. When the lever is released, it automatically retracts to the locked position so that there is no danger of a patient leaving the swinging lavatory in an unlocked position.

A further feature of the present invention is that the stabilizing bar is adjustable to take care of uneven floors, rugs or the like. Thus, considerable leeway is allowed in mounting the unit since the final adjustment of the stabilizer can be made after the unit is in place.

Other objects and features of the invention will be brought out in the balance of the specification.

DESCRIPTION OF THE PREFERRED EMBODIMENTS

Figure 1:
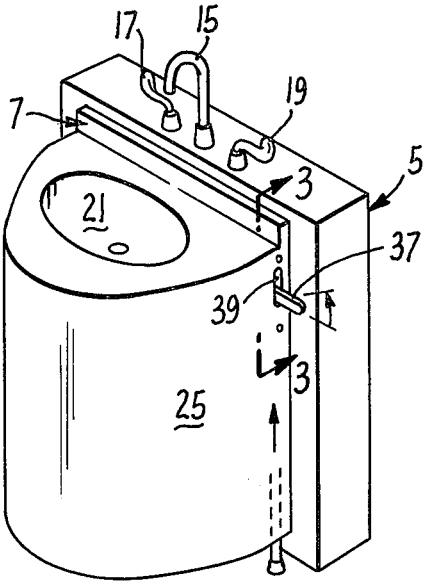
FIG. 1 is a perspective view of a combination fixture embodying the present invention.
Figure 2:
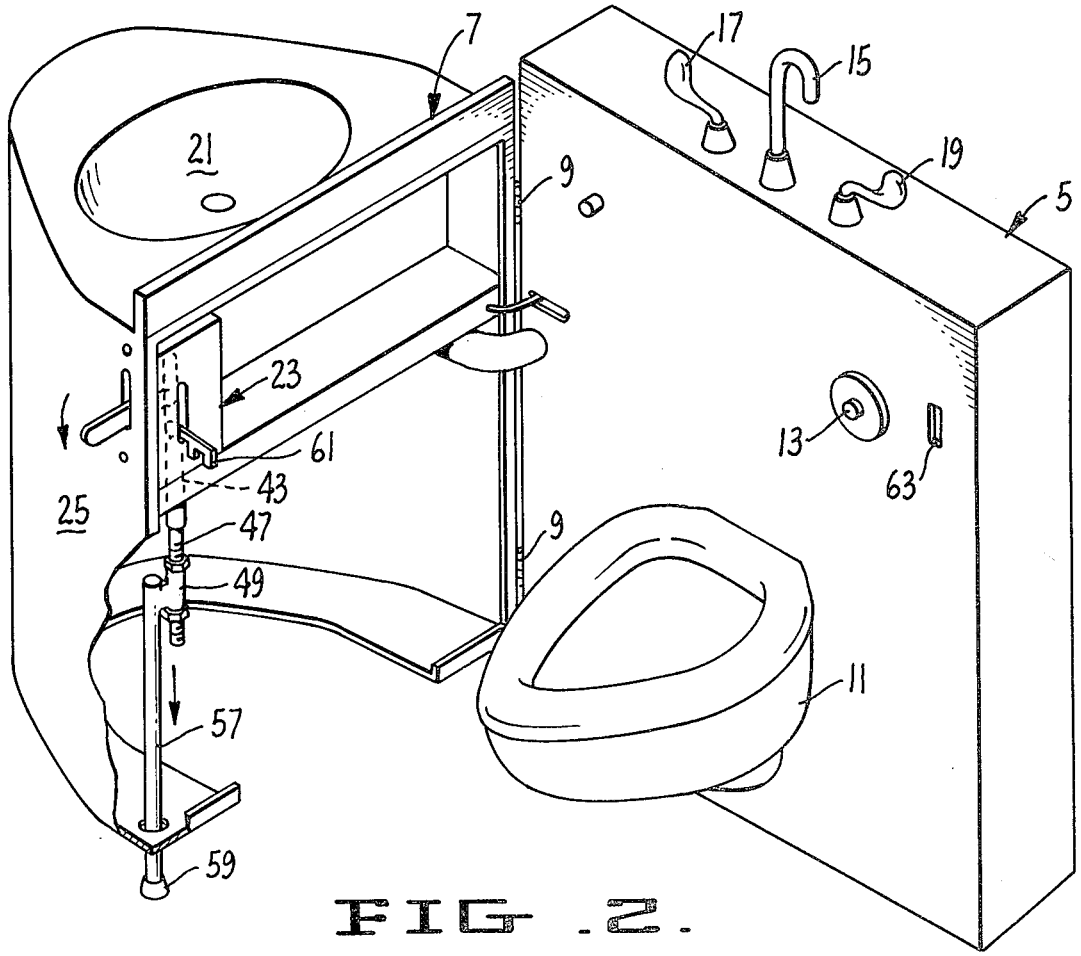
FIG. 2 is an enlarged perspective view, partly in section, showing a combination fixture embodying the present invention with the lavatory swung to the open position.

Referring now to the drawings by reference characters, there is shown a combination fixture having a frame member 5 with a lavatory support member 7 mounted thereon for swinging movement by hinges 9. Mounted on the support member 5 is a toilet bowl 11 having a flush button 13. Also mounted on the frame member 5 is a water supply spout 15 and the valve handles 17 and 19 for supplying water to a wash basin 21 mounted on the lavatory support member 7. Preferably, spout 15 swings back and forth from an operative position as shown in FIG. 1 to an inoperative position as is shown in FIG. 2 to protect the user of the toilet, both from the chance of mechanical injury from the spout as well as from an untimely discharge of water from the spout while using the toilet.

The crux of the present invention is a latch member generally designated 23 which serves the dual purpose of latching the wash basin support 7 against the frame 5 and also for anchoring the wash basin in a fixed position when the wash basin is extended from the frame 5 to enable one to use the toilet.

Figure 3:
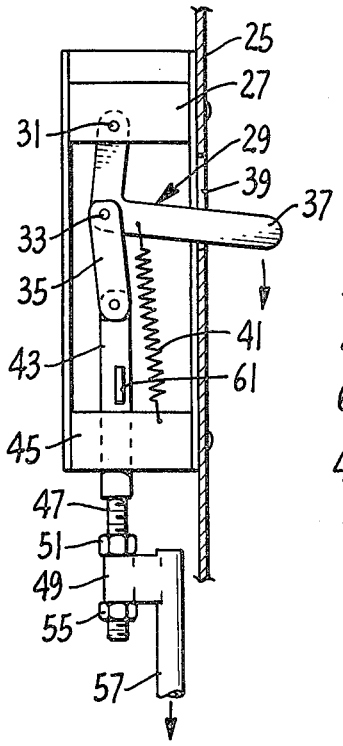
FIG. 3 is an enlarged section on the line 3—3 of FIG. 1.

The swinging lavatory support 7 holds the wash basin 21 as well as a downwardly extending skirt 25. Skirt 25 supports a bracket 27 to which is pivoted an L-shaped lever arm generally designated 29. Lever arm 29 has an upper pivot 31 and a lower pivot 33 which is connected to the short link 35. As is obvious from FIG. 3, this pivoting arrangement forms a toggle. One arm of the lever 29 designated 37 extends outwardly through a slot 39 in skirt 25 forming a handle. Spring 41 biases the toggle in a downward direction as is shown in FIG. 3.

Mounted below the link 35 is a sliding arm 43 which is mounted for sliding movement in the bracket 45. The bottom end of this member is threaded as at 47 and a sleeve 49 is slidably mounted over this threaded portion and held in place by an upper jam nut 51 and a lower jam nut 55. The sleeve 49 is connected to arm 57 which extends downwardly to tip 59 which is adapted to engage the floor.

Also connected to the arm 43 is a latch member 61 which is adapted to mate with a slot 63 in the frame member 5.

Figure 4:
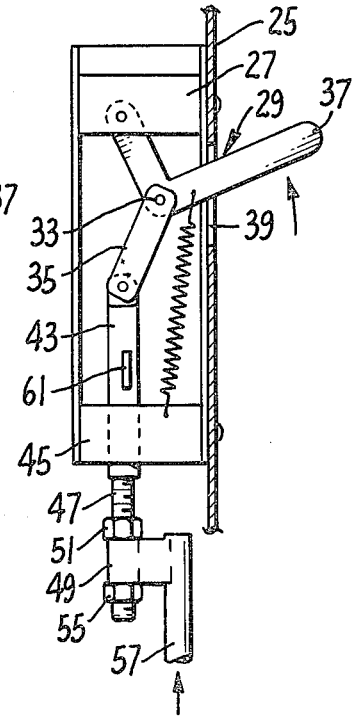
FIG. 4 is a view similar to FIG. 3 but showing the lever and stabilizing rod in the upper position.

It is believed that the operation of the device is obvious. When the handle is held down as is shown in FIGS. 1, 2 and 3 by means of the spring, and the wash basin is against the frame 5, latch 61 engages the slot 63 locking the wash basin against the frame so that the wash basin can be used. In order to swing the wash basin out of the way so that the toilet can be used, it is necessary that handle 37 be raised, as is shown in FIG. 4. This disengages the latch 61 from the slot 63 and also raises the arm 57. Now one can swing the wash basin outwardly to a desired position and immediately upon release of the handle 37, spring 41 will cause the arm 57 to descend, locking the tip 59 against the floor and thus stabilizing the wash basin so that there will be no danger of its swinging if one leans against it or uses it as an assist bar in getting on or off the toilet. Since the action is entirely automatic upon the release of the handle 37, there is no possibility of an infirm patient leaving the wash basin in an unstable position where it might swing when used as a support.

When a device of the present invention is installed, the exact positioning of the arm 57 can be adjusted by using the jam nuts 51 and 55. Thus, it is not necessary to make a precise installation of the device in a room since any variations in the height at which the frame 5 is mounted or any variations in the floor such as uneven tile, concrete or the absence or presence of a carpet can be compensated for by the proper adjustment of the nuts 51 and 55.

It will be obvious to those skilled in the art that many variations can be made in the exact structure shown without departing from the spirit of this invention.

I claim:

1. In a combination wash basin and toilet fixture wherein the toilet bowl is mounted on a fixed frame and the wash basin is mounted on a swinging frame by means of hinges whereby the wash basin can be swung to a first position flush with the main frame to enable one to use the wash basin and can be swung to a second position away from the main frame to enable one to use the toilet, the improvement comprising a latch mechanism, said latch mechanism having a downwardly extending arm with an operating handle connected thereto and having a spring means to normally bias said arm in a down position whereby upon release of said operating handle, said arm will move downwardly and engage the floor, stabilizing the wash basin in the second position.

2. The structure of claim 1 wherein a toggle linkage is provided to actuate said arm.

* * * * *